US011261507B2

(12) United States Patent
Newman et al.

(10) Patent No.: US 11,261,507 B2
(45) Date of Patent: Mar. 1, 2022

(54) ALUMINUM ALLOY PRODUCTS

(71) Applicant: Alcoa Inc., Pittsburgh, PA (US)

(72) Inventors: John Newman, Export, PA (US); Tim Hosch, Plum, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 506 days.

(21) Appl. No.: 15/005,191

(22) Filed: Jan. 25, 2016

(65) Prior Publication Data

US 2016/0215370 A1 Jul. 28, 2016

Related U.S. Application Data

(60) Provisional application No. 62/107,202, filed on Jan. 23, 2015.

(51) Int. Cl.

| | |
|---|---|
| ***C22F 1/05*** | (2006.01) |
| ***C22C 21/02*** | (2006.01) |
| ***C22C 21/08*** | (2006.01) |

(52) U.S. Cl.

CPC ..... *C22C 21/02* (2013.01); *C22C 21/08* (2013.01); *C22F 1/05* (2013.01)

(58) Field of Classification Search

None

See application file for complete search history.

(56) References Cited

U.S. PATENT DOCUMENTS 4,094,705 A * 6/1978 Sperry ..... C22C 21/06 148/439
7,182,825 B2 2/2007 Unal et al.
2005/0211350 A1 9/2005 Unal et al.
2014/0014237 A1 1/2014 Yokoi et al.
2014/0366998 A1 12/2014 Kamat et al.

FOREIGN PATENT DOCUMENTS

| | | | | |
|---|---|---|---|---|
| JP | 2003-129156 A | | 5/2003 | |
| JP | 2006257475 A | * | 9/2006 | |
| JP | 2006257475 A | | 9/2006 | |
| WO | WO-2013133976 A1 | * | 9/2013 | ..... C22C 21/08 |
| WO | 2014135367 A1 | | 9/2014 | |

OTHER PUBLICATIONS

International Search Report and Written Opinion for PCT Application No. PCT/US2016/014669, dated Apr. 8, 2016, (7 pages).

M.G. Chu and J.E. Jacoby, "Macrosegregation characteristics of commercial size aluminum alloy ingot cast by the direct chill method", Light Metals 1990, ed. C.M. Bickert, The Minerals, Metals and Materials Society, 1990, pp. 819-824.

J.R. Davies, "Solidification Structures and of Aluminum Alloy Structures, Aluminum and Aluminum Alloys," ASM Specialty Handbook, Jan. 1, 1993, ASM International, Ohio, XP002784921, ISBN: 978-0-87170-496-2, pp. 523-531.

* cited by examiner

*Primary Examiner* — Anthony M Liang
(74) *Attorney, Agent, or Firm* — Greenberg Traurig, LLP

(57) ABSTRACT

The aluminum alloy product of an embodiment of the present invention includes a pair of outer regions and an inner region positioned between the outer regions. A first concentration of eutectic forming alloying elements in the inner region is less than a second concentration of eutectic forming alloying elements in each of the outer regions. Further, the aluminum alloy product has a delta r value of 0 to 0.10. The delta r value is calculated as follows: Absolute Value [(r_L+r_LT−2*r_45)/2] and the r_L is an r value in a longitudinal direction of the aluminum alloy product, the r_LT is an r value in a transverse direction of the aluminum alloy product, and the r_45 is an r value in a 45 degree direction of the aluminum alloy product.

9 Claims, No Drawings

ALUMINUM ALLOY PRODUCTS

RELATED APPLICATIONS

This application claims the priority of U.S. provisional patent application No. 62/107,202; filed Jan. 23, 2015; entitled "ALUMINUM ALLOY PRODUCTS", which is incorporated herein by reference in its entirety for all purposes.

TECHNICAL FIELD

The present invention relates to aluminum alloys.

BACKGROUND

Cast aluminum alloy products are known.

SUMMARY OF INVENTION

In an embodiment, the aluminum alloy product comprises: a pair of outer regions and an inner region positioned between the outer regions. In the embodiment, a first concentration of eutectic forming alloying elements in the inner region is less than a second concentration of eutectic forming alloying elements in each of the outer regions. In the embodiment, the aluminum alloy product has a delta r value of 0 to 0.10. In the embodiment, the delta r value is calculated as follows:

Absolute Value $[(r_L+r_LT-2*r_45)/2]$ wherein r_L is an r value in a longitudinal direction of the aluminum alloy product;

wherein r_LT is an r value in a transverse direction of the aluminum alloy product; and wherein r_45 is an r value in a 45 degree direction of the aluminum alloy product.

In another embodiment, a temper of the aluminum alloy product is selected from the group consisting of T4, T43, and O temper. In yet another embodiment, the temper of the aluminum alloy product is T4. In some embodiments, the temper of the aluminum alloy product is T43.

In other embodiments, the aluminum alloy is selected from the group consisting of 2xxx, 6xxx, and 7xxx series alloys. In yet other embodiments, the aluminum alloy is a 6xxx series alloy. In some embodiments, the aluminum alloy is a 6022 aluminum alloy.

In some embodiments, the delta r value is 0 to 0.07. In other embodiments, the delta r value is 0 to 0.05.

In another embodiment, the aluminum alloy product comprises: a pair of outer regions and an inner region positioned between the outer regions. In the embodiment, the inner region comprises globular dendrites. In the embodiments, the aluminum alloy product has a delta r value of 0 to 0.10. In the embodiment, the delta r value is calculated as follows:

Absolute Value $[(r_L+r_LT-2*r_45)/2]$ wherein r_L is an r value in a longitudinal direction of the aluminum alloy product;

wherein r_LT is an r value in a transverse direction of the aluminum alloy product; and wherein r_45 is an r value in a 45 degree direction of the aluminum alloy product.

In another embodiment, a temper of the aluminum alloy product is selected from the group consisting of T4, T43, and O temper. In yet another embodiment, the temper of the aluminum alloy product is T4. In some embodiments, the temper of the aluminum alloy product is T43.

In other embodiments, the aluminum alloy is selected from the group consisting of 2xxx, 6xxx, and 7xxx series alloys. In yet other embodiments, the aluminum alloy is a 6xxx series alloy. In some embodiments, the aluminum alloy is a 6022 aluminum alloy.

In some embodiments, the delta r value is 0 to 0.07. In other embodiments, the delta r value is 0 to 0.05.

DETAILED DESCRIPTION

Among those benefits and improvements that have been disclosed, other objects and advantages of this invention will become apparent from the following description. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

As used herein, the "delta r value" is calculated based on the following equation:

Absolute Value $[(r_L+r_LT-2*r_45)/2]$ wherein r_L is an r value in a longitudinal direction of the aluminum alloy product;

wherein r_LT is an r value in a transverse direction of the aluminum alloy product; and wherein r_45 is an r value in a 45 degree direction of the aluminum alloy product.

As used herein, the term "r value" is the plastic strain ratio or the ratio of the true width strain to the true thickness strain as defined in the equation r value=$\varepsilon w/\varepsilon t$. The r value is measured using an extensometer to gather width strain data during a tensile test while measuring longitudinal strain with an extensometer. The true plastic length and width strains are then calculated, and the thickness strain is determined from a constant volume assumption. The r value is then calculated as the slope of the true plastic width strain vs true plastic thickness strain plot obtained from the tensile test.

As used herein, the term "feedstock" refers to an aluminum alloy in strip form. In some embodiments, the feedstock employed in the practice of the present invention is prepared by continuous casting as detailed in U.S. Pat. Nos. 5,515,908, 6,672,368 and 7,125,612, each of which are assigned to the assignee of the present invention and incorporated herein by reference for all purposes. In some embodiments, the feedstock is generated using belt casters and/or roll casters.

As used herein, "strip" may be of any suitable thickness, and is generally of sheet gauge (0.006 inch to 0.249 inch) or thin-plate gauge (0.250 inch to 0.400 inch), i.e., has a thickness in the range of 0.006 inch to 0.400 inch. In one embodiment, the strip has a thickness of at least 0.040 inch. In one embodiment, the strip has a thickness of no greater than 0.320 inch. In one embodiment, the strip has a thickness of from 0.0070 to 0.018, such as when used for canning/packaging applications. In some embodiments, the strip has a thickness in the range of 0.06 to 0.25 inch. In some embodiments, the strip has a thickness in the range of 0.08 to 0.14 inch. In some embodiments, the strip has a thickness in the range of 0.08 to 0.20 inch. In some embodiments, the strip has a thickness in the range of 0.1 to 0.25 inches in thickness.

In some embodiments, the aluminum alloy strip has a width up to about 90 inches, depending on desired continued processing and the end use of the strip. In some embodiments, the aluminum alloy strip has a width up to about 80 inches, depending on desired continued processing and the end use of the strip. In some embodiments, the aluminum alloy strip has a width up to about 70 inches, depending on desired continued processing and the end use of the strip. In some embodiments, the aluminum alloy strip has a width up to about 60 inches, depending on desired continued processing and the end use of the strip. In some embodiments, the aluminum alloy strip has a width up to about 50 inches, depending on desired continued processing and the end use of the strip.

As used herein, the phrase "an aluminum alloy that is selected from the group consisting of 1xxx, 2xxx, 3xxx, 4xxx, 5xxx, 6xxx, 7xxx, and 8xxx series aluminum alloys" and the like means an aluminum alloy selected from the group consisting of 1xxx, 2xxx, 3xxx, 4xxx, 5xxx, 6xxx, 7xxx, and 8xxx series aluminum alloys registered with the Aluminum Association and unregistered variants of the same.

As used herein, the term "temperature" may refer to an average temperature, a maximum temperature, or a minimum temperature.

As used herein, the term "anneal" refers to a heating process that primarily causes recrystallization of the metal to occur. In some embodiments, anneal may further include dissolution of soluble constituent particles based, at least in part, on the size of the soluble constituent particles and the annealing temperature. Typical temperatures used in annealing aluminum alloys range from about 500 to 900° F.

Also as used herein, the term "solution heat treatment" refers to a metallurgical process in which the metal is held at a high temperature so as to cause the second phase particles of the alloying elements to dissolve into solid solution. Temperatures used in solution heat treatment are generally higher than those used in annealing, and range up to the melting temperature of the metal which is typically about 1100° F. This condition is then maintained by quenching of the metal for the purpose of strengthening the final product by controlled precipitation (aging).

As used herein, the term "eutectic forming alloying elements" includes Fe, Si, Ni, Zn and the like and excludes peritectic forming elements such as Ti, Cr, V and Zr.

As used herein, the term "globular dendrites" refers to dendrites that are globe-shaped or spherical.

As used herein, the term "T4 temper" and the like means a product that has been solution heat-treated, cold worked and naturally aged to a substantially stable condition. In some embodiments, T4 temper products are not cold worked after solution heat-treatment, or in which the effect of cold work in flattening or straightening may not be recognized in mechanical property limits.

As used herein, the term "O temper" means a cast product that has been annealed to improve ductility and dimensional stability.

In an embodiment, the aluminum alloy product comprises: a pair of outer regions and an inner region positioned between the outer regions. In the embodiment, a first concentration of eutectic forming alloying elements in the inner region is less than a second concentration of eutectic forming alloying elements in each of the outer regions. In the embodiment, the aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the aluminum alloy product;

wherein r_LT is an r value in a transverse direction of the aluminum alloy product; and wherein r_45 is an r value in a 45 degree direction of the aluminum alloy product.

In another embodiment, a temper of the aluminum alloy product is selected from the group consisting of T4, T43, and O temper. In yet another embodiment, the temper of the aluminum alloy product is T4. In some embodiments, the temper of the aluminum alloy product is T43.

In other embodiments, the aluminum alloy is selected from the group consisting of 2xxx, 6xxx, and 7xxx series alloys. In yet other embodiments, the aluminum alloy is a 6xxx series alloy. In some embodiments, the aluminum alloy is a 6022 aluminum alloy.

In some embodiments, the delta r value is 0 to 0.07. In other embodiments, the delta r value is 0 to 0.05.

In another embodiment, the aluminum alloy product comprises: a pair of outer regions and an inner region positioned between the outer regions. In the embodiment, the inner region comprises globular dendrites. In the embodiments, the aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the aluminum alloy product;

wherein r_LT is an r value in a transverse direction of the aluminum alloy product; and wherein r_45 is an r value in a 45 degree direction of the aluminum alloy product.

In another embodiment, a temper of the aluminum alloy product is selected from the group consisting of T4, T43, and O temper. In yet another embodiment, the temper of the aluminum alloy product is T4. In some embodiments, the temper of the aluminum alloy product is T43.

In other embodiments, the aluminum alloy is selected from the group consisting of 2xxx, 6xxx, and 7xxx series alloys. In yet other embodiments, the aluminum alloy is a 6xxx series alloy. In some embodiments, the aluminum alloy is a 6022 aluminum alloy.

In some embodiments, the delta r value is 0 to 0.07. In other embodiments, the delta r value is 0 to 0.05.

In some embodiments, the present invention is an aluminum alloy product comprising a pair of outer regions and an inner region positioned between the outer regions. In the embodiment, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T4 temper, the T4 aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T4 aluminum alloy product;

wherein r_LT is an r value in a transverse direction of the T4 aluminum alloy product; and wherein r_45 is an r value in a 45 degree direction of the T4 aluminum alloy product.

In some embodiments, the present invention is an aluminum alloy product comprising a pair of outer regions and an inner region positioned between the outer regions. In the embodiment, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T4x temper, the T4x aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T4x aluminum alloy product;

wherein r_LT is an r value in a transverse direction of the T4x aluminum alloy product; and wherein r_45 is an r value in a 45 degree direction of the T4x aluminum alloy product.

In some embodiments, the present invention is an aluminum alloy product comprising a pair of outer regions and an inner region positioned between the outer regions. In the embodiment, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T43 temper, the T43 aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T43 aluminum alloy product;

wherein r_LT is an r value in a transverse direction of the T43 aluminum alloy product; and wherein r_45 is an r value in a 45 degree direction of the T43 aluminum alloy product.

In some embodiments, the present invention is an aluminum alloy product comprising a pair of outer regions and an inner region positioned between the outer regions. In the embodiment, the inner region comprises globular dendrites. In some embodiments, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T4 temper, the T4 aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T4 aluminum alloy product;

wherein r_LT is an r value in a transverse direction of the T4 aluminum alloy product; and wherein r_45 is an r value in a 45 degree direction of the T4 aluminum alloy product.

In some embodiments, the present invention is an aluminum alloy product comprising a pair of outer regions and an inner region positioned between the outer regions. In the embodiment, the inner region comprises globular dendrites. In some embodiments, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T4x temper, the T4x aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T4x aluminum alloy product;

wherein r_LT is an r value in a transverse direction of the T4x aluminum alloy product; and wherein r_45 is an r value in a 45 degree direction of the T4x aluminum alloy product.

In some embodiments, the present invention is an aluminum alloy product comprising a pair of outer regions and an inner region positioned between the outer regions. In the embodiment, the inner region comprises globular dendrites. In some embodiments, a first concentration of eutectic forming alloying elements in the inner region is less than a second concentration of eutectic forming alloying elements in each of the outer regions. In the embodiment, when the aluminum alloy product is heat treated sufficiently to form an aluminum alloy product having a T43 temper, the T43 aluminum alloy product has a delta r value of 0 to 0.10. In the embodiment, the delta r value is calculated as follows:

$$\text{Absolute Value } [(r_L+r_LT-2*r_45)/2]$$

wherein r_L is an r value in a longitudinal direction of the T43 aluminum alloy product;

wherein r_LT is an r value in a transverse direction of the T43 aluminum alloy product; and wherein r_45 is an r value in a 45 degree direction of the T43 aluminum alloy product.

In some embodiments, the T4 aluminum alloy product has a delta r value of 0 to 0.09. In some embodiments, the T4 aluminum alloy product has a delta r value of 0 to 0.08. In some embodiments, the T4 aluminum alloy product has a delta r value of 0 to 0.07. In some embodiments, the T4 aluminum alloy product has a delta r value of 0 to 0.06. In some embodiments, the T4 aluminum alloy product has a delta r value of 0 to 0.05. In some embodiments, the T4 aluminum alloy product has a delta r value of 0 to 0.04. In some embodiments, the T4 aluminum alloy product has a delta r value of 0 to 0.03. In some embodiments, the T4 aluminum alloy product has a delta r value of 0 to 0.02. In some embodiments, the T4 aluminum alloy product has a delta r value of 0 to 0.01. In some embodiments, the T4 aluminum alloy product has a delta r value of 0.005.

In some embodiments, the T4 aluminum alloy product has a delta r value of 0.005 to 0.10. In some embodiments, the T4 aluminum alloy product has a delta r value of 0.01 to 0.10. In some embodiments, the T4 aluminum alloy product has a delta r value of 0.02 to 0.10. In some embodiments, the T4 aluminum alloy product has a delta r value of 0.03 to 0.10. In some embodiments, the T4 aluminum alloy product has a delta r value of 0.04 to 0.10. In some embodiments, the T4 aluminum alloy product has a delta r value of 0.05 to 0.10. In some embodiments, the T4 aluminum alloy product has a delta r value of 0.06 to 0.10. In some embodiments, the T4 aluminum alloy product has a delta r value of 0.07 to 0.10. In some embodiments, the T4 aluminum alloy product has a delta r value of 0.08 to 0.10. In some embodiments, the T4 aluminum alloy product has a delta r value of 0.09 to 0.10.

In some embodiments, the T4x aluminum alloy product has a delta r value of 0 to 0.09. In some embodiments, the T4x aluminum alloy product has a delta r value of 0 to 0.08. In some embodiments, the T4x aluminum alloy product has a delta r value of 0 to 0.07. In some embodiments, the T4x aluminum alloy product has a delta r value of 0 to 0.06. In some embodiments, the T4x aluminum alloy product has a delta r value of 0 to 0.05. In some embodiments, the T4x aluminum alloy product has a delta r value of 0 to 0.04. In some embodiments, the T4x aluminum alloy product has a delta r value of 0 to 0.03. In some embodiments, the T4x aluminum alloy product has a delta r value of 0 to 0.02. In some embodiments, the T4x aluminum alloy product has a delta r value of 0 to 0.01. In some embodiments, the T4x aluminum alloy product has a delta r value of 0.005.

In some embodiments, the T4x aluminum alloy product has a delta r value of 0.005 to 0.10. In some embodiments, the T4x aluminum alloy product has a delta r value of 0.01 to 0.10. In some embodiments, the T4x aluminum alloy product has a delta r value of 0.02 to 0.10. In some embodiments, the T4x aluminum alloy product has a delta r value of 0.03 to 0.10. In some embodiments, the T4x aluminum alloy product has a delta r value of 0.04 to 0.10. In some embodiments, the T4x aluminum alloy product has a delta r value of 0.05 to 0.10. In some embodiments, the T4x aluminum alloy product has a delta r value of 0.06 to 0.10. In some embodiments, the T4x aluminum alloy product has a delta r value of 0.07 to 0.10. In some embodiments, the T4x aluminum alloy product has a delta r value of 0.08 to 0.10. In some embodiments, the T4x aluminum alloy product has a delta r value of 0.09 to 0.10.

In some embodiments, the aluminum alloy product is a T43 aluminum alloy product. In some embodiments, the T43 aluminum alloy product has a delta r value of 0 to 0.09. In some embodiments, the T43 aluminum alloy product has a delta r value of 0 to 0.08. In some embodiments, the T43 aluminum alloy product has a delta r value of 0 to 0.07. In some embodiments, the T43 aluminum alloy product has a delta r value of 0 to 0.06. In some embodiments, the T43 aluminum alloy product has a delta r value of 0 to 0.05. In some embodiments, the T43 aluminum alloy product has a delta r value of 0 to 0.04. In some embodiments, the T43 aluminum alloy product has a delta r value of 0 to 0.03. In some embodiments, the T43 aluminum alloy product has a delta r value of 0 to 0.02. In some embodiments, the T43 aluminum alloy product has a delta r value of 0 to 0.01. In some embodiments, the T43 aluminum alloy product has a delta r value of 0.005.

In some embodiments, the T43 aluminum alloy product has a delta r value of 0.005 to 0.10. In some embodiments, the T43 aluminum alloy product has a delta r value of 0.01 to 0.10. In some embodiments, the T43 aluminum alloy product has a delta r value of 0.02 to 0.10. In some embodiments, the T43 aluminum alloy product has a delta r value of 0.03 to 0.10. In some embodiments, the T43 aluminum alloy product has a delta r value of 0.04 to 0.10. In some embodiments, the T43 aluminum alloy product has a delta r value of 0.05 to 0.10. In some embodiments, the T43 aluminum alloy product has a delta r value of 0.06 to 0.10. In some embodiments, the T43 aluminum alloy product has a delta r value of 0.07 to 0.10. In some embodiments, the T43 aluminum alloy product has a delta r value of 0.08 to 0.10. In some embodiments, the T43 aluminum alloy product has a delta r value of 0.09 to 0.10.

In some embodiments, the aluminum alloy product is anO aluminum alloy product. In some embodiments, the O aluminum alloy product has a delta r value of 0 to 0.09. In some embodiments, the O aluminum alloy product has a delta r value of 0 to 0.08. In some embodiments, the O aluminum alloy product has a delta r value of 0 to 0.07. In some embodiments, the O aluminum alloy product has a delta r value of 0 to 0.06. In some embodiments, the O aluminum alloy product has a delta r value of 0 to 0.05. In some embodiments, the O aluminum alloy product has a delta r value of 0 to 0.04. In some embodiments, the O aluminum alloy product has a delta r value of 0 to 0.03. In some embodiments, the O aluminum alloy product has a delta r value of 0 to 0.02. In some embodiments, the O aluminum alloy product has a delta r value of 0 to 0.01. In some embodiments, the O aluminum alloy product has a delta r value of 0.005.

In some embodiments, the O aluminum alloy product has a delta r value of 0.005 to 0.10. In some embodiments, the O aluminum alloy product has a delta r value of 0.01 to 0.10.

In some embodiments, the O aluminum alloy product has a delta r value of 0.02 to 0.10. In some embodiments, the O aluminum alloy product has a delta r value of 0.03 to 0.10. In some embodiments, the O aluminum alloy product has a delta r value of 0.04 to 0.10. In some embodiments, the O aluminum alloy product has a delta r value of 0.05 to 0.10. In some embodiments, the O aluminum alloy product has a delta r value of 0.06 to 0.10. In some embodiments, the O aluminum alloy product has a delta r value of 0.07 to 0.10. In some embodiments, the O aluminum alloy product has a delta r value of 0.08 to 0.10. In some embodiments, the O aluminum alloy product has a delta r value of 0.09 to 0.10.

In some embodiments, the aluminum alloy product comprises an aluminum alloy that is selected from the group consisting of 1xxx, 2xxx, 3xxx, 4xxx, 5xxx, 6xxx, 7xxx, and 8xxx series aluminum alloys. In some embodiments, the aluminum alloy product comprises a 2xxx, 6xxx, or 7xxx series aluminum alloy. In some embodiments, the aluminum alloy product comprises a 2xxx series aluminum alloy. In some embodiments, the aluminum alloy product comprises a 6xxx series aluminum alloy. In some embodiments, the aluminum alloy product comprises a 7xxx series aluminum alloy. In some embodiments, the aluminum alloy product comprises a 6022 aluminum alloy.

In some embodiments, the aluminum alloy product is an aluminum alloy strip. In some embodiments, the aluminum alloy product may be of an O or T temper. In some embodiments, the aluminum alloy product may be of a T4 temper. In some embodiments, the aluminum alloy product may be of a T4x temper. In some embodiments, the aluminum alloy product may be of a T43 temper.

In some embodiments, the aluminum alloy product according to the present invention may be manufactured by the following method: (i) providing a continuously-cast aluminum alloy strip as feedstock; (ii) hot or warm rolling the feedstock to the required thickness in-line via at least one stand, optionally to the final product gauge, (iii) cold rolling the feedstock; (iv) solution heat-treating the feedstock in-line or offline, depending on alloy and temper desired; and (v) quenching the feedstock, after which it is may be tension-leveled and coiled. In some embodiments, the aluminum alloy product may be manufactured by combinations of steps (i)-(v) detailed above.

In some embodiments, the continuously-cast aluminum alloy strip is formed by the casting methods detailed in U.S. Pat. Nos. 5,515,908, 6,672,368, and/or 7,125,612, incorporated by reference herein for all purposes.

In some embodiments, hot or warm rolling is conducted using one stand. In some embodiments, hot or warm rolling is conducted using two stands. In some embodiments, hot or warm rolling is conducted using three stands. In some embodiments, hot or warm rolling is conducted using four stands. In some embodiments, hot or warm rolling is conducted using five stands. In some embodiments, hot or warm rolling is conducted using six stands. In some embodiments, hot or warm rolling is conducted using more than six stands.

In some embodiments, hot or warm rolling is carried out at temperatures within the range of 400 F to 1000 F. In some embodiments, hot or warm rolling is carried out at temperatures within the range of 400 F to 900 F. In some embodiments, hot or warm rolling is carried out at temperatures within the range of 400 F to 800 F. In some embodiments, hot or warm rolling is carried out at temperatures within the range of 400 F to 700 F. In some embodiments, hot or warm rolling is carried out at temperatures within the range of 400 F to 600 F. In some embodiments, hot or warm rolling is carried out at temperatures within the range of 500 F to 1000 F. In some embodiments, hot or warm rolling is carried out at temperatures within the range of 600 F to 1000 F. In some embodiments, hot or warm rolling is carried out at temperatures within the range of 700 F to 1000 F. In some embodiments, hot or warm rolling is carried out at temperatures within the range of 800 F to 1000 F. In some embodiments, hot or warm rolling is carried out at temperatures within the range of 700 F to 900 F.

In some embodiments, the extent of the reduction in thickness affected by the hot rolling step or steps, including one or more hot rolling stands of the present invention is intended to reach the required finish gauge or intermediate gauge. In some embodiments, a first hot rolling stand reduces the as-cast thickness by 10 to 35%. In one embodiment, the first hot rolling stand reduces the as-cast thickness by 12 to 34%. In another embodiment, the first hot rolling stand reduces the as-cast thickness by 13 to 33%. In yet another embodiment, the first hot rolling stand reduces the as-cast thickness by 14 to 32%. In another embodiment, the first hot rolling stand reduces the as-cast thickness by 15 to 31%. In yet another embodiment, the first hot rolling stand reduces the as-cast thickness by 16 to 30%. In another embodiment, the first hot rolling stand reduces the as-cast thickness by 17 to 29%.

In one embodiment, a first hot rolling stand and a second hot rolling stand reduce the as-cast thickness by 5% to 99%. In another embodiment, the combination of the first hot rolling stand plus the second hot rolling stand reduces the as-cast thickness 10% to 99%. In yet another embodiment, the combination of the first hot rolling stand plus the second hot rolling stand reduces the as-cast thickness by 20% to 99%. In another embodiment, the combination of the first hot rolling stand plus the second hot rolling stand reduces the as-cast thickness by 25% to 99%. In yet another embodiment, the combination of the first hot rolling stand plus the second hot rolling stand reduces the as-cast thickness by 30% to 99%. In any of these embodiments, the combination of the first hot rolling stand plus the second hot rolling stand reduces the as-cast thickness by 40% to 99%. In any of these embodiments, the combination of the first hot rolling stand plus the second hot rolling stand reduces the as-cast thickness by 50% to 99%. In any of these embodiments, the combination of the first hot rolling stand plus the second hot rolling stand reduces the as-cast thickness by 60% to 99%.

In any of these embodiments, the combination of the first hot rolling stand plus the second hot rolling stand reduces the as-cast thickness by 5% to 99%. In any of these embodiments, the combination of the first hot rolling stand plus the second hot rolling stand reduces the as-cast thickness by 5% to 90%. In any of these embodiments, the combination of the first hot rolling stand plus the second hot rolling stand reduces the as-cast thickness by 5% to 80%. In any of these embodiments, the combination of the first hot rolling stand plus the second hot rolling stand reduces the as-cast thickness by 5% to 70%. In any of these embodiments, the combination of the first hot rolling stand plus the second hot rolling stand reduces the as-cast thickness by 5% to 60%. In any of these embodiments, the combination of the first hot rolling stand plus the second hot rolling stand reduces the as-cast thickness by 5% to 50%. In any of these embodiments, the combination of the first hot rolling stand plus the second hot rolling stand reduces the as-cast thickness by 5% to 40%. In any of these embodiments, the combination of the first hot rolling stand plus the second hot rolling stand reduces the as-cast thickness by 5% to 30%. In any of these embodiments, the combination of the first hot rolling stand plus the second hot rolling stand reduces the as-cast thickness by 5% to 25%. In any of these embodiments, the combination of the first hot rolling stand plus the second hot rolling stand reduces the as-cast thickness by 5% to 20%.

In any of these embodiments, the combination of the first hot rolling stand plus the second hot rolling stand reduces the as-cast thickness by 10% to 60%. In any of these embodiments, the combination of the first hot rolling stand plus the second hot rolling stand reduces the as-cast thickness by 15% to 55%. In any of these embodiments, the combination of the first hot rolling stand plus the second hot rolling stand reduces the as-cast thickness by 20% to 50%.

In some embodiments, the hot rolled product may be cold rolled by any conventional method of cold rolling.

In some embodiments, the temperature of the solution heat treating and the subsequent quenching step will vary depending on the desired temper. In some embodiments, the solution heat treatment step is conducted at a temperature of greater than 900 degrees F. In some embodiments, the solution heat treatment step is conducted at a temperature of 900 to 1100 degrees F. In some embodiments, the solution heat treatment step is conducted at a temperature of 950 to 1100 degrees F. In some embodiments, the solution heat treatment step is conducted at a temperature of 1000 to 1100 degrees F. In some embodiments, the solution heat treatment step is conducted at a temperature of 1050 to 1100 degrees F. In some embodiments, the solution heat treatment step is conducted at a temperature of 900 to 1050 degrees F. In some embodiments, the solution heat treatment step is conducted at a temperature of 900 to 1000 degrees F. In some embodiments, the solution heat treatment step is conducted at a temperature of 900 to 950 degrees F.

In some embodiments, the solution heat treatment step is conducted for 5 seconds to 2 minutes. In some embodiments, the solution heat treatment step is conducted for 5 seconds to 1.8 minutes. In some embodiments, the solution heat treatment step is conducted for 5 seconds to 1.5 minutes. In some embodiments, the solution heat treatment step is conducted for 5 seconds to 1.2 minutes. In some embodiments, the solution heat treatment step is conducted for 5 seconds to 1 minute. In some embodiments, the solution heat treatment step is conducted for 5 seconds to 55 seconds. In some embodiments, the solution heat treatment step is conducted for 5 seconds to 50 seconds. In some embodiments, the solution heat treatment step is conducted for 5 seconds to 45 seconds. In some embodiments, the solution heat treatment step is conducted for 5 seconds to 40 seconds. In some embodiments, the solution heat treatment step is conducted for 5 seconds to 35 seconds. In some embodiments, the solution heat treatment step is conducted for 5 seconds to 30 seconds. In some embodiments, the solution heat treatment step is conducted for 5 seconds to 25 seconds. In some embodiments, the solution heat treatment step is conducted for 5 seconds to 20 seconds. In some embodiments, the solution heat treatment step is conducted for 5 seconds to 15 seconds. In some embodiments, the solution heat treatment step is conducted for 5 seconds to 10 seconds.

In some embodiments, the quenching will depend upon the temper desired in the final product. In some embodiments, feedstock which has been solution heat-treated will be quenched via air and/or water to temperature ranging from 70 to 250 degree F. In some embodiments, feedstock which has been solution heat-treated will be quenched via air and/or water to temperature ranging from 80 to 200 degree F. In some embodiments, feedstock which has been solution heat-treated will be quenched via air and/or water to temperature ranging from 100 to 200 degree F. In some embodiments, feedstock which has been solution heat-treated will be quenched via air and/or water to temperature ranging from 100 to 150 degree F. In some embodiments, feedstock which has been solution heat-treated will be quenched via air and/or water to temperature ranging from 70 to 180 degree F. In some embodiments, the feedstock is air-quenched. In some embodiments, the feedstock is water quenched. In some embodiments, the quenched feedstock will be coiled.

In some embodiments, the quench is a water quench or an air quench or a combined quench in which water is applied first to bring the temperature of the sheet to just above the Leidenfrost temperature (about 550 degree F. for many aluminum alloys) and is continued by an air quench.

In another embodiment, annealing may be performed after hot or warm rolling, before cold rolling or after cold rolling. In this embodiment, the feed stock proceeds through hot rolling, cold rolling, and annealing. Additional steps may include trimming, tension-leveling and coiling. In some embodiments, no intermediate annealing step is performed.

In some embodiments, it is believed that the higher magnesium content in the after-cast product may result in high delta r values.

Non-Limiting Examples

The following examples are intended to illustrate the invention and should not be construed as limiting the invention in any way.

The compositions of the aluminum alloys included in the examples and comparative examples are included in Table 1.

TABLE 1

| Example/Comparative Example | Si | Fe | Cu | Mn | Mg |
|---|---|---|---|---|---|
| Example 1 | 0.68 | 0.12 | 0.10 | 0.07 | 0.53 |
| Example 2 | 0.68 | 0.13 | 0.10 | 0.07 | 0.54 |
| Example 3 | 0.71 | 0.24 | 0.11 | 0.07 | 0.53 |

TABLE 1-continued

| Example/Comparative Example | Si | Fe | Cu | Mn | Mg |
|---|---|---|---|---|---|
| Example 4 | 0.7 | 0.2 | 0.1 | 0.07 | 0.52 |
| Example 5 | 0.74 | 0.29 | 0.11 | 0.07 | 0.53 |
| Example 6 | 0.69 | 0.18 | 0.11 | 0.06 | 0.55 |
| Example 7 | 0.74 | 0.28 | 0.11 | 0.07 | 0.53 |
| Example 8 | 0.69 | 0.17 | 0.11 | 0.07 | 0.56 |
| Example 9 | 0.68 | 0.19 | 0.11 | 0.06 | 0.55 |
| Example 10 | 0.67 | 0.19 | 0.1 | 0.07 | 0.54 |
| Comparative Example 1 | 0.84 | 0.13 | 0.08 | 0.08 | 0.60 |
| Comparative Example 2 | 0.85 | 0.13 | 0.04 | 0.08 | 0.61 |
| Comparative Example 3 | 0.87 | 0.14 | 0.05 | 0.08 | 0.60 |
| Comparative Example 4 | 0.85 | 0.14 | 0.05 | 0.08 | 0.59 |
| Comparative Example 5 | 0.84 | 0.13 | 0.07 | 0.07 | 0.61 |
| Comparative Example 6 | 0.87 | 0.12 | 0.07 | 0.07 | 0.58 |
| Comparative Example 7 | 0.85 | 0.14 | 0.06 | 0.08 | 0.62 |

Example 1 was cast at a speed greater than 50 feet per minute to a thickness of 0.13 inches and was processed in line by hot rolling in two stands to an intermediate gauge of 0.08 inches. Example 2 was cast at a speed greater than 50 feet per minute to a thickness of 0.16 inches and was processed in line by hot rolling in one stand to an intermediate gauge of 0.14 inches. Both alloys were then cold rolled off line to a final gauge of 0.04 inches and processed to a T43 temper, which included heating to about 950° F. to 1000° F. for about 15 to 30 seconds followed by air quenching to about 100° F.

Examples 3-10 were cast at a speed greater than 50 feet per minute to a thickness detailed in Table 2 and then hot rolled in two stands to the gauge detailed in Table 2. Example 3-10 were then heated to about 1000° F. to 1050° F. for about 60 to 90 seconds and then water quenched to below 100° F. to achieve a T4 temper.

TABLE 2

| Example | Final Gauge (inches) |
|---|---|
| Example 1 | 0.04 |
| Example 2 | 0.04 |
| Example 3 | 0.04 |
| Example 4 | 0.04 |
| Example 5 | 0.04 |
| Example 6 | 0.06 |
| Example 7 | 0.06 |
| Example 8 | 0.04 |
| Example 9 | 0.04 |
| Example 10 | 0.06 |

Comparative Examples 1-7 were direct chill cast and were subjected to homogenization, hot work, and cold rolling to achieve the gauges detailed in Table 3. The comparative examples were also heated to about 1000° F. to 1050° F. for about 60 to 90 seconds and then water quenched to below 100° F. to achieve a T4 temper.

TABLE 3

| Comparative Example | Final Gauge (inches) |
|---|---|
| Comparative Example 1 | 0.06 |
| Comparative Example 2 | 0.08 |
| Comparative Example 3 | 0.08 |
| Comparative Example 4 | 0.08 |
| Comparative Example 5 | 0.05 |
| Comparative Example 6 | 0.05 |
| Comparative Example 7 | 0.08 |

The r-values in each of the longitudinal direction, the transverse direction, and the 45 degree direction were then calculated for the examples and comparative examples using the procedure detailed herein. The delta r values for the examples and comparative examples were then calculated using the formula detailed herein. The r values and calculated delta r values for Examples 1-10 are shown in Table 4 and the r values and calculated delta r values for Comparative Examples 1-7 are shown in Table 5.

TABLE 4

| Example | Direction | r Value | delta r |
|---|---|---|---|
| Example 1 | L | 0.66 | 0.04 |
| | LT | 0.67 | |
| | 45 | 0.70 | |
| Example 2 | L | 0.70 | 0.01 |
| | LT | 0.64 | |
| | 45 | 0.66 | |
| Example 3 | L | 0.75 | 0.06 |
| | LT | 0.73 | |
| | 45 | 0.68 | |
| Example 4 | L | 0.74 | 0.04 |
| | LT | 0.74 | |
| | 45 | 0.78 | |
| Example 5 | L | 0.69 | 0.03 |
| | LT | 0.71 | |
| | 45 | 0.73 | |
| Example 6 | L | 0.73 | 0.02 |
| | LT | 0.75 | |
| | 45 | 0.76 | |
| Example 7 | L | 0.75 | 0.02 |
| | LT | 0.77 | |
| | 45 | 0.78 | |
| Example 8 | L | 0.69 | 0.07 |
| | LT | 0.68 | |
| | 45 | 0.75 | |
| Example 9 | L | 0.68 | 0.07 |
| | LT | 0.72 | |
| | 45 | 0.77 | |
| Example 10 | L | 0.78 | 0.06 |
| | LT | 0.79 | |
| | 45 | 0.84 | |

TABLE 5

| Comparative Example | Direction | r Value | delta r |
|---|---|---|---|
| Comparative Example 1 | L | 0.89 | 0.27 |
| | LT | 0.58 | |
| | 45 | 0.46 | |
| Comparative Example 2 | L | 0.97 | 0.37 |
| | LT | 0.75 | |
| | 45 | 0.49 | |
| Comparative Example 3 | L | 0.87 | 0.31 |
| | LT | 0.68 | |
| | 45 | 0.47 | |
| Comparative Example 4 | L | 0.83 | 0.30 |
| | LT | 0.64 | |
| | 45 | 0.43 | |

TABLE 5-continued

| Comparative Example | Direction | r Value | delta r |
|---|---|---|---|
| Comparative Example 5 | L | 0.85 | 0.33 |
| | LT | 0.63 | |
| | 45 | 0.42 | |
| Comparative Example 6 | L | 0.86 | 0.27 |
| | LT | 0.62 | |
| | 45 | 0.47 | |
| Comparative Example 7 | L | 0.81 | 0.24 |
| | LT | 0.57 | |
| | 45 | 0.45 | |

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

We claim:

1. An aluminum alloy strip comprising:

a pair of outer regions and an inner region positioned between the outer regions;

wherein a first concentration of eutectic forming alloying elements in the inner region is less than a second concentration of eutectic forming alloying elements in each of the outer regions;

wherein the aluminum alloy strip comprises an aluminum alloy, wherein the aluminum alloy is selected from the group consisting of 2xxx, 6xxx, and 7xxx series alloys;

wherein the aluminum alloy strip has a delta r value of 0 to 0.10;

wherein the delta r value is calculated as follows:

$$\text{Absolute Value } [(r_L+r_LT-2*_{r}_45)/2]$$

wherein r_L is an r value in a longitudinal direction of the aluminum alloy strip;

wherein r_LT is an r value in a transverse direction of the aluminum alloy strip; and wherein r_45 is an r value in a 45 degree direction of the aluminum alloy strip.

2. The aluminum alloy strip of claim 1, wherein a temper of the aluminum alloy strip is selected from the group consisting of T4, T43, and O temper.

3. The aluminum alloy strip of claim 2, wherein the temper of the aluminum alloy strip is T4.

4. The aluminum alloy strip of claim 2, wherein the temper of the aluminum alloy strip is T43.

5. The aluminum alloy strip of claim 1, wherein the aluminum alloy is a 6xxx series alloy.

6. The aluminum alloy strip of claim 1, wherein the aluminum alloy is a 6022 aluminum alloy.

7. The aluminum alloy strip of claim 1, wherein the delta r value is 0 to 0.07.

8. The aluminum alloy strip of claim 1, wherein the delta r value is 0 to 0.05.

9. The aluminum alloy strip of claim 1, wherein the inner region comprises globular dendrites.

* * * * *